United States Patent [19]

Vecchiarelli

[11] 4,254,813

[45] Mar. 10, 1981

[54] VALANCE BRACKET FOR VERTICAL VENETIAN BLIND

[75] Inventor: Francis Vecchiarelli, River Edge, N.J.

[73] Assignee: Hunter Douglas International N.V., Netherlands Antilles

[21] Appl. No.: 50,305

[22] Filed: Jun. 20, 1979

[51] Int. Cl.[3] ..... E06B 9/00

[52] U.S. Cl. ..... 160/19; 160/38; 160/39

[58] Field of Search ..... 160/19, 38, 39, 178 R, 160/345; 16/94 D

[56] References Cited

U.S. PATENT DOCUMENTS

| | | | |
|---|---|---|---|
| 2,323,496 | 7/1943 | Stern et al. | 160/39 |
| 3,134,132 | 5/1964 | Graber | 16/94 D |
| 3,299,943 | 1/1967 | Poe | 160/176 |
| 3,836,107 | 9/1974 | Barry | 160/38 |
| 3,927,437 | 12/1975 | Ford | 160/345 |
| 4,079,770 | 3/1978 | Woodle | 160/39 |

*Primary Examiner*—Peter M. Caun

*Attorney, Agent, or Firm*—Pennie & Edmonds

[57] ABSTRACT

A device for mounting the headrail of a vertical Venetian blind and for holding a valance to the headrail in which a bracket has the valance mounted on it and carries a rearwardly extending arm which is engageable in a rearwardly extending channel formed in a clip body. The clip can be hooked on to and snap in to elongate recesses in the front and rear flanges of the headrail and the clip carries members which mount the clip, the headrail and the bracket to a support thereabove. The clip also carries detents which engage in holes in the rearward arm of the bracket so that the position of the valance can be adjusted.

10 Claims, 3 Drawing Figures

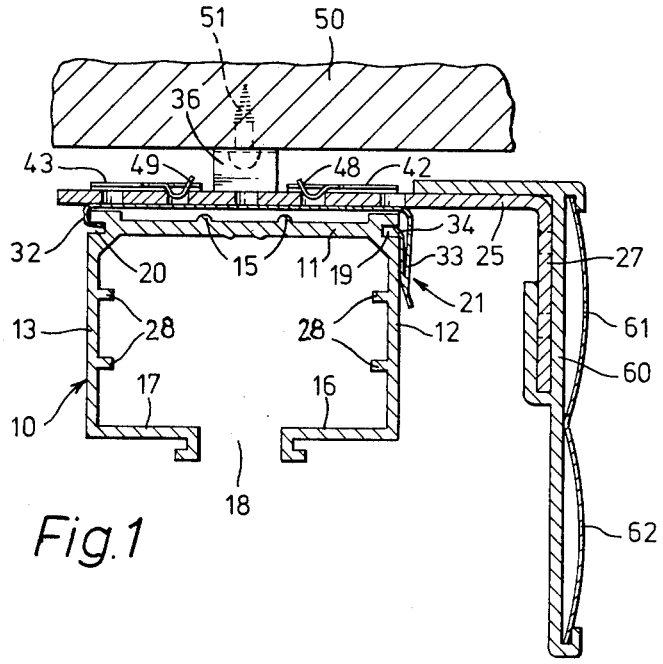
Fig.1
Fig.3
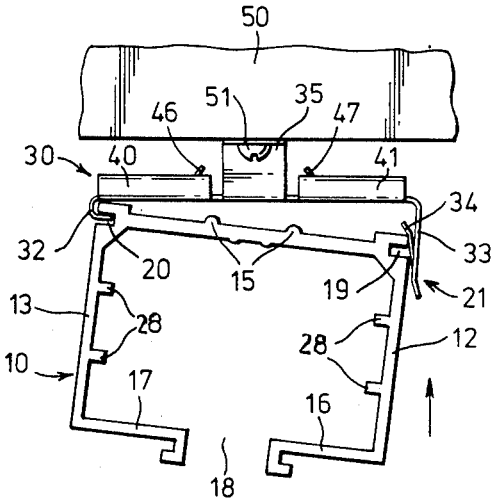

VALANCE BRACKET FOR VERTICAL VENETIAN BLIND

BACKGROUND OF THE INVENTION

The present invention relates to vertical Venetian blinds.

Various forms of vertical Venetian blinds have been proposed and diverse systems for holding these blinds to a support are known. It is very often advantageous with vertical Venetian blinds to have a valance which extends in front of the headrail, the valance having a more pleasing appearance than the headrail itself and covering the headrail and the support arrangement.

One particular form of headrail for a vertical Venetian blind includes a member of generally inverted channel cross-section having an upper web and front and rear flanges. The flanges each have, adjacent the upper web, an elongate recess which extends along the length of the headrail which is conveniently formed by extrusion, for example from aluminium. This structure of headrail while convenient for the purpose for which it is intended, is rather unsightly and a valance is most advantageous, therefore. The arrangements for holding the valance and for holding the Venetian blind are rather cumbersome and do not enable the headrail and valance to be mounted easily.

SUMMARY OF THE INVENTION

It is now proposed, according to the present invention, to provide a device for mounting the headrail of a vertical Venetian blind and for holding a valance to the headrail, said headrail being of inverted channel cross-section having an upper web and downwardly extending front and rear flanges, said flanges being provided adjacent the web with elongate recesses extending the length of the headrail, said device comprising, in combination:

(i) a valance mounting bracket including a rearwardly extending arm having at least one hole therein;

(ii) a clip including:

(a) a clip body;

(b) a hook at one end of said body engageable in the elongate recess of the rear flange of the headrail;

(c) a leg at the other end of said body adapted to overlie the other flange of said headrail;

(d) a first detent on said leg engageable in the elongate recess of the other flange of the headrail to retain said clip on said headrail;

(e) at least one upstanding member on said body having an aperture for the passage of fixing means to hold said clip body to a support thereabove;

(f) means defining a rearwardly extending channel on said clip body of a width to receive the rearwardly extending arm of the bracket; and (g) at least one second detent on said body engageable with said at least one hole in the rearwardly extending arm of the bracket.

The device of the present invention is relatively simple in its structure and is easy to use. One simply applies the clip to an overhead support, for example a ceiling or lintel of a window and passes screws or other fixing means up through the apertures thereby holding the clip in place. Usually two or more clips are mounted in this manner and thereafter the headrail is offered up so that the hook engages in the recess in the one flange and the headrail is then moved so that its forward end is pushed upwardly and the first detent of the other leg snaps in to the recess in the other flange of the headrail. The headrail is then fixed in position and the valance support bracket, which will normally already have the valance on it, can then be pushed so that its rearward arm passes in to the channel on the associated clip and the second detent or detents thereon engage in the hole or holes in the bracket to locate the bracket and the valance in the desired position.

Where more than one hole is provided, this enables the position of the valance support bracket to be adjusted relative to the headrail.

In the convenient construction the bracket includes a forward downwardly extending arm upon which the valance is carried.

Preferably there are two upstanding members on the clip body, and each of these upstanding members is an inverted L-shaped construction, having the aperture in the horizontal arm thereof. The vertical arm of the or each upstanding L-shaped member is sufficiently long to allow the second detents room to flex.

In a particularly convenient construction, there are four limbs which extend upwardly, two on each side of the clip body, and then inwardly towards one another. These limbs each define the rearwardly extending channel and carry one of the second detents thereon. The rearwardly extending arm of the bracket then preferably has two rearwardly extending rows of holes, the four detents being engageable with these holes.

Advantageously the clip is of a unitary stamped out structure and can be made of spring steel.

The invention also provides a vertical Venetian blind, comprising, in combination:

(i) a headrail of inverted channel cross-section and including:

(a) an upper web;

(b) front and rear flanges;

(c) means defining an elongate recess extending the length of the headrail in said front and rear flanges adjacent said web;

(ii) a valance mounting bracket including a rearwardly extending arm having at least one hole therein;

(iii) a clip including:

(a) a clip body;

(b) a hook at the one end of said body engaged in the elongate recess of the one flange of the headrail;

(c) a leg at the other end of said body overlying the other flange of said headrail;

(d) a first detent on said leg engaged in the elongate recess of the other flange of said headrail to retain said clip on said headrail;

(e) at least one upstanding member on said body having an aperture for the passage of fixing means to hold said clip body to a support thereabove;

(f) means defining a rearwardly extending channel on said clip body, said channel receiving the rearwardly extending arm of said bracket;

(g) at least one second detent on said body engaged with it so that at least one hole in the rearwardly extending arm of the bracket;

(v) a valance mounted on said bracket to extend in front of said headrail.

In order that the invention may more readily be understood, the following description is given, merely by way of example, of a presently preferred mode of putting the invention into effect. Reference is made to the accompanying drawings.

BRIEF DESCRIPTION OF THE DRAWINGS

FIG. 1 is an end view, in cross-section, of the presently preferred embodiment of the device according to the invention mounted on a vertical Venetian blind headrail;

FIG. 3 is an end view, similar to FIG. 1, showing the headrail being put in place.

DETAILED DESCRIPTION OF A PRESENTLY PREFERRED EMBODIMENT

Figure 2:
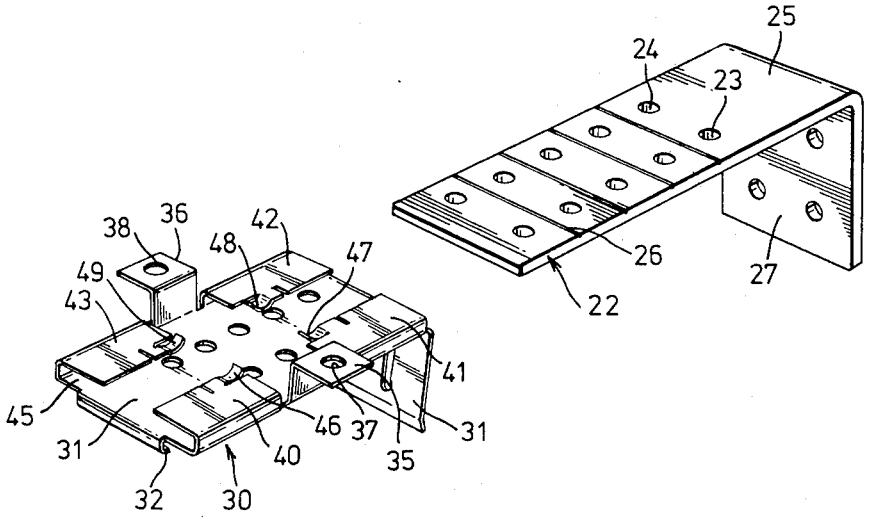
FIG. 2 is a perspective exploded view of the device itself.

Referring first to FIG. 1 of the drawings, there is illustrated the headrail 10 of a vertical Venetian blind. This headrail is of generally inverted channel cross-section comprising an upper web 11 and front and rear flanges 12 and 13, these are guiding ribs 28 for the slot carriers. Reinforcing ribs 15 are provided on the exterior of the web 11.

Extending inwardly from the lower edges of the flanges are lower web portions 16 and 17 respectively defining an opening 18 for the passage of the hanger elements for the Venetian blind.

At the junction of the web 11 with the front and rear flanges are two elongate recesses 19 and 20 which extend the full length of the headrail.

In order to mount the headrail over a window or the like, a mounting device indicated by the general reference numeral 21 is provided and this is illustrated in greater detail in FIG. 2. The device 21 comprises firstly an L-shaped bracket 22 which is formed with two rows of holes 23 and 24 which extend parallel to the length of a rearwardly extending arm 25. It will be noted that the arm 25 is provided with a number of lines of weakness 26 which enable certain portions of the arm 25 to be snapped off when a shorter bracket is required. The bracket also includes a forward downwardly extending arm 27 for a reason to be explained later.

The device 21 also includes a clip 30 which has a clip body 31 provided at one of its ends, in this instance the rear end, with a hook member 32. At the forward end, the clip has a downwardly depending leg 33 having in its rear face a detent 34 (see FIG. 1).

Referring again to FIG. 2 it will be seen that the body is provided with two upstanding members 35 and 36 which are bent over to form horizontal portions respectively provided with apertures 37 and 38.

The body is also provided with four limbs 40, 41, 42 and 43 which extend upwardly from the edges of the body and then inwardly towards one another. The limbs thus define a channel 45 which is dimensioned to receive the arm 25 of the bracket 22. At their inner central edges the limbs 40 to 43 are provided with detents 46 to 49 respectively which are bent first down and then upwardly to provide a curved arc.

In use, the clip 30 is first of all secured to a ceiling surface 50, (see FIGS. 1 and 3) by means of screws 51 which are passed through the apertures 37 and 38. It will be noted that the upstanding portion of the members 35 and 36 is sufficiently high to give ample clearance above the detents 46 to 49.

With the clip thus in position, the headrail 10 is offered up to the bracket or preferably to two or more similarly fixed brackets, so that the rear elongate recess 20 can be engaged on the hook 32 of each clip. The headrail is then pivoted slightly so that the upper front edge of the web slides up the inside or back of the leg 33 flexing it out. The detent 34 will then spring in to the recess 19 and this will hold the headrail in place.

Thereafter the bracket 22, which has a valance 60 with valance facing members 61 and 62 clipped therein is put in place. This is achieved by sliding the arms 25 of the brackets in to the channels 45 formed in the clips. The detents 46 to 49 will spring upwardly and will snap down in to the apertures 23, 24. This operation is continued until the valance is the desired distance from the headrail.

It will be appreciated that one can make the bracket shorter by snapping off the lines of weakness 26. Also, instead of having the clips arranged in the manner illustrated they can be arranged the other way round so that the hook is at the front and engages in the front recess of the headrail the pivoting action then taking place the other way so that the leg, which is now at the rear, will flex rearwardly during the final fixing of the headrail.

It will be appreciated that the construction of the present invention is very simple indeed and can enable the headrail itself and the valance to be mounted easily.

The clip may be made of sheet metal or advantageously is made of a spring steel. As can be seen in FIG. 2, the clip itself can be made as a unitary member by, for example, a stamping operation.

I claim:

1. A device for mounting the headrail of a vertical Venetian blind and for holding a valance to the headrail, said headrail being of inverted channel cross-section having an upper web and downwardly extending front and rear flanges, said flanges being provided adjacent the web with elongate recesses extending the length of the headrail, said device comprising, in combination:

(i) a valance mounting bracket including a rearwardly extending arm having at least one hole therein;

(ii) a clip including:

(a) a clip body;

(b) a hook at one end of said body engageable in the elongate recess of the rear flange of the headrail;

(c) a leg at the other end of said body adapted to overlie the other flange of said headrail;

(d) a first detent on said leg engageable in the elongate recess of the other flange of the headrail to retain said clip on said headrail;

(e) at least one upstanding member on said body having an aperture for the passage of fixing means to hold said clip body to a support thereabove;

(f) means defining a rearwardly extending channel on said clip body of a width to receive the rearwardly extending arm of the bracket; and (g) at least one second detent on said body engageable with said at least one hole in the rearwardly extending arm of the bracket.

2. A device as claimed in claim 1, wherein said bracket includes a forward downwardly extending arm for carrying said valance.

3. A device as claimed in claim 1, wherein there are two upstanding members on said clip body, each upstanding member being of inverted L-shaped construction, having the aperture in the horizontal arm thereof.

4. A device as claimed in claim 1, and further comprising at least two limbs which extend first upwardly one from each side of said clip body, and then inwardly towards one another, said limbs forming said means defining a rearwardly extending channel and each carrying a said second detent thereon, and wherein said rearwardly extending arm of said bracket has at least two holes therein, one engageable by each said second detent.

5. A device as claimed in claim 1, and further comprising four limbs which extend first upwardly two from each side of said clip body and then inwardly towards one another, said limbs forming said means defining a rearwardly extending channel and each carrying a said second detent thereon, and wherein said rearwardly extending arm of said bracket has two rearwardly extending rows of holes, said four second detents being engageable with said holes.

6. A device as claimed in claim 1, wherein said clip comprises a unitary member punched out from spring steel.

7. A vertical Venetian blind comprising, in combination:

(i) a head rail of inverted channel cross-section and including:

(a) an upper web;

(b) front and rear flanges;

(c) means defining an elongate recess extending the length of the headrail in said front and rear flanges adjacent said web;

(ii) a valance mounting bracket including a rearwardly extending arm having at least one hole therein;

(iii) a clip including:

(a) a clip body;

(b) a hook at the one end of said body engaged in the elongate recess of the one flange of the headrail;

(c) a leg at the other end of said body overlying the other flange of said headrail;

(d) a first detent on said leg engaged in the elongate recess of the other flange of said headrail to retain said clip on said headrail;

(e) at least one upstanding member on said body having an aperture for the passage of fixing means to hold said clip body to a support thereabove;

(f) means defining a rearwardly extending channel on said clip body, said channel receiving the rearwardly extending arm of said bracket;

(g) at least one second detent on said body engaged with it so that at least one hole in the rearwardly extending arm of the bracket;

(iv) a valance mounted on said bracket to extend in front of said headrail.

8. A vertical Venetian blind as claimed in claim 7 wherein said bracket includes a forward downwardly extending arm carrying said valance.

9. A vertical Venetian blind as claimed in claim 7 and further comprising four limbs which extend first upwardly, two from each side of said clip body and then inwardly toward one another, said limbs defining said rearwardly extending channel and each carrying a said second detent thereon and wherein said rearwardly extending arm has two rearwardly extending rows of holes, said four detents engaging with said holes.

10. A vertical Venetian blind as claimed in claim 9 wherein said clip is formed as a unitary structure of spring steel.

* * * * *

UNITED STATES PATENT AND TRADEMARK OFFICE

CERTIFICATE OF CORRECTION

PATENT NO. : 4,254,813
DATED : March 10, 1981
INVENTOR(S) : Francis Vecchiarelli It is certified that error appears in the above-identified patent and that said Letters Patent are hereby corrected as shown below:

Col. 2, line 18, delete "the or"
line 60, delete "it so that";
line 61, after the ";" add --and,--;
line 62, change "v" to --iv--;

Col. 6, line 17, delete "it so that"

Signed and Sealed this

*Sixteenth* Day of *March 1982*

[SEAL]

*Attest:*

GERALD J. MOSSINGHOFF

*Attesting Officer*

*Commissioner of Patents and Trademarks*